US005132655A

United States Patent [19]

Suzuki et al.

[11] Patent Number: 5,132,655

[45] Date of Patent: Jul. 21, 1992

[54] ELECTROMAGNETIC COIL APPARATUS

[75] Inventors: Shigemitsu Suzuki, Fontainebleau; Hiroaki Morioka, Aichi, both of France

[73] Assignee: Aisin Seiki K.K., Aichi, Japan

[21] Appl. No.: 586,186

[22] Filed: Sep. 21, 1990

[30] Foreign Application Priority Data

Sep. 22, 1989 [JP] Japan ..... 1-111056[U]
Sep. 29, 1989 [JP] Japan ..... 1-115071[U]

[51] Int. Cl.[5] ..... H01F 15/10; H01F 27/04
[52] U.S. Cl. ..... 336/192; 336/107
[58] Field of Search ..... 335/299; 336/192, 107, 336/96, 92, 90

[56] References Cited

U.S. PATENT DOCUMENTS

| | | | |
|---|---|---|---|
| 3,860,896 | 1/1975 | Van Der Hoek | 336/96 |
| 4,412,196 | 10/1983 | Teichert | 335/250 |
| 4,514,712 | 4/1985 | McDougal | 336/96 |
| 4,849,728 | 7/1989 | Goll et al. | 336/92 |
| 4,954,801 | 9/1991 | Urbanski et al. | 336/90 |

*Primary Examiner*—Leo P. Picard
*Assistant Examiner*—Ramon M. Barrera
*Attorney, Agent, or Firm*—Sughrue, Mion, Zinn, Macpeak & Seas

[57] ABSTRACT

An electromagnetic coil apparatus has an electromagnetic coil for generaing an electromagnetic flux. The electromagnetic coil includes a coil wire wound on a coil bobbin with an end of the wire extending outwardly from the electromagnetic coil. An elastic terminal cap is connected to the coil bobbin with the wire end arranged between the terminal cap and the coil bobbin to eliminate stress from the wire end.

3 Claims, 4 Drawing Sheets

ELECTROMAGNETIC COIL APPARATUS

BACKGROUND OF THE INVENTION

The present invention relates generally to an electromagnetic coil apparatus. More particularly, the present invention is concerned with an improved structure of the apparatus which is not affected by environmental factors.

An electromagnetic coil apparatus is often used in, for example, a hydraulic control circuit for controlling a hydraulic flow. A conventional electromagnetic coil apparatus is disclosed in FIGS. 4 and 5.

Referring now to FIG. 4, an electromagnetic coil apparatus 50 basically includes a coil bobbin 51, an electric coil 52, an electric terminal 53 and an outer housing 54. The coil bobbin 51 forms a center hole 51*a* and the electric coil 52 is wound on the coil bobbin 51. The electric coil 52 is comprised of an electric wire 52*a* having an electric wire end 52*b* which is molded into the outer housing 54. The outer housing 54 forms a cylindrical connecting portion 54*a*. A valve assembly (not shown), for example, may be arranged in the center hole 51*a*. The electric terminal 53 is molded into the coil bobbin 51 and the outer housing 54. The outer housing 54 is formed about the coil 52 and the coil bobbin 51 with the end 52*b* of the electric wire 52*a* molded into the outer housing as described above. A detailed view of the arrangement of the electric wire end 52*b* relative to the housing and the bobbin is shown in FIG. 5 which clearly shows the electric wire end 52*b* being molded completely within the outer housing 54.

In operation with a valve assembly, the electromagnetic coil apparatus 50 is generally subjected to vibrations and/or high temperature conditions. As a result, an expansion or contraction of the electric wire end 52*b* and the electric terminal 53 will occur. Therefore, serious problems are present with the above-described design. For example, if these operating conditions are maintained, the electric wire end 52*b* and/or the outer housing 54 may be damaged or broken. Once the electromagnetic coil apparatus 50 is broken, the normal operation will be prevented.

SUMMARY OF THE INVENTION

Accordingly, it is one of the primary objects of the present invention to provide an electromagnetic coil apparatus which eliminates stress on the end of the electric wire.

It is another object of the present invention to provide a long-lived operable electromagnetic coil apparatus.

It is still a further object of this invention to provide an electromagnetic coil apparatus which solves the above described drawbacks of the conventional electromagnetic coil apparatus.

To achieve the above objects and in accordance with the principles of the invention as embodied and broadly described herein, the electromagnetic coil apparatus comprises a coil bobbin, a coil wire wound on the coil bobbin to define an electromagnetic coil, a projecting portion formed at an end portion of the coil bobbin and a resilient terminal cap connected to the projecting portion, said wire having an end extending from the electromagnetic coil with the wire end arranged between the terminal cap and the projecting portion.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
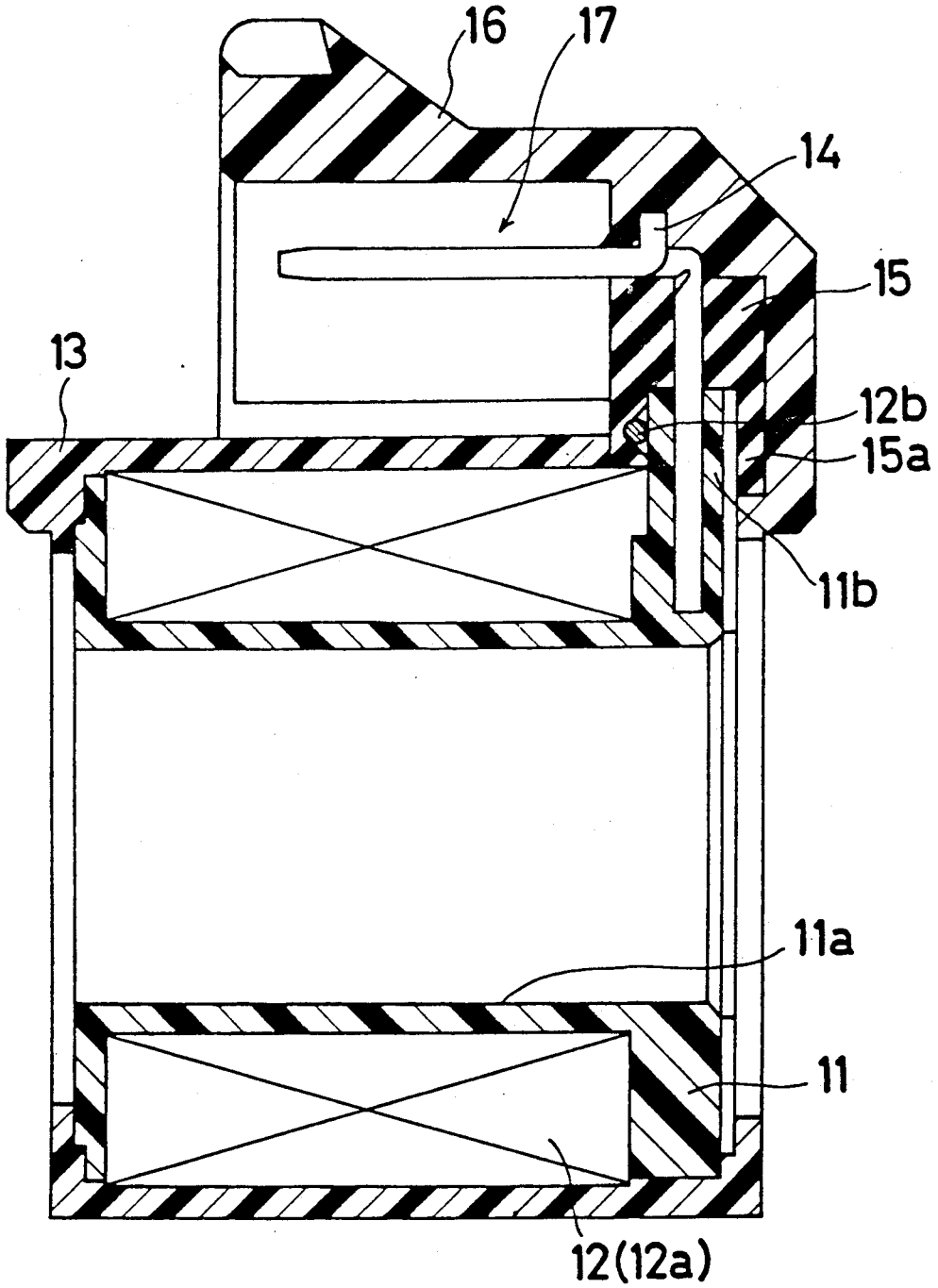
FIG. 1 is a cross-sectional view of an electromagnetic coil apparatus according to a first embodiment of the present invention.
Figure 2:
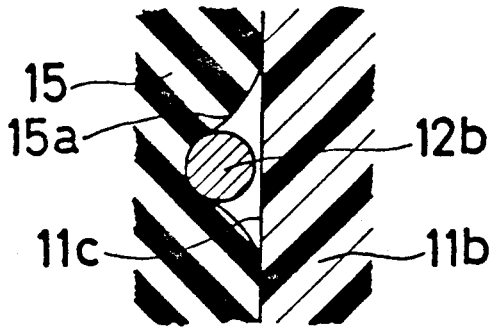
FIG. 2 is an enlarged view of the circulate portion I of FIG. 1 of the first embodiment.
Figure 5:
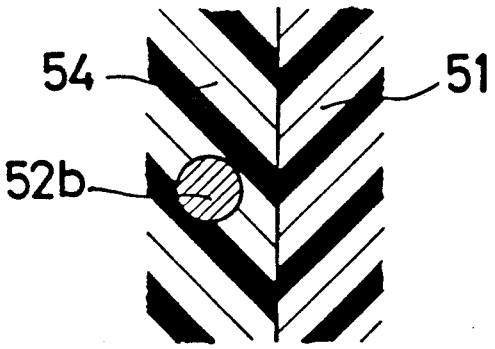
Fig. 5 PRIOR ART
FIG. 5 presents an enlarged view of a portion of FIG. 4.
Figure 3:
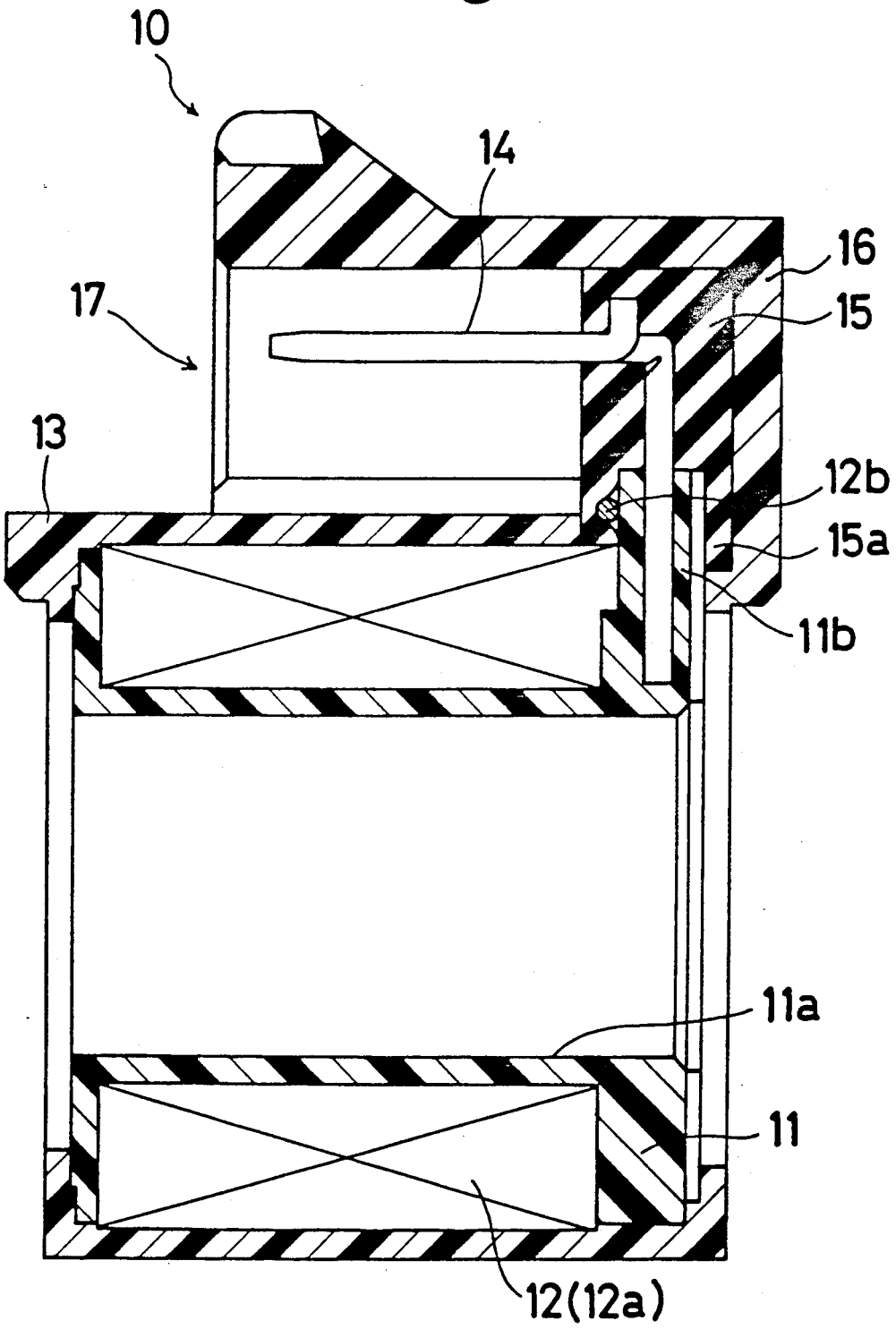
FIG. 3 represents a cross-sectional view of an electromagnetic coil apparatus of the second embodiment.
Figure 4:
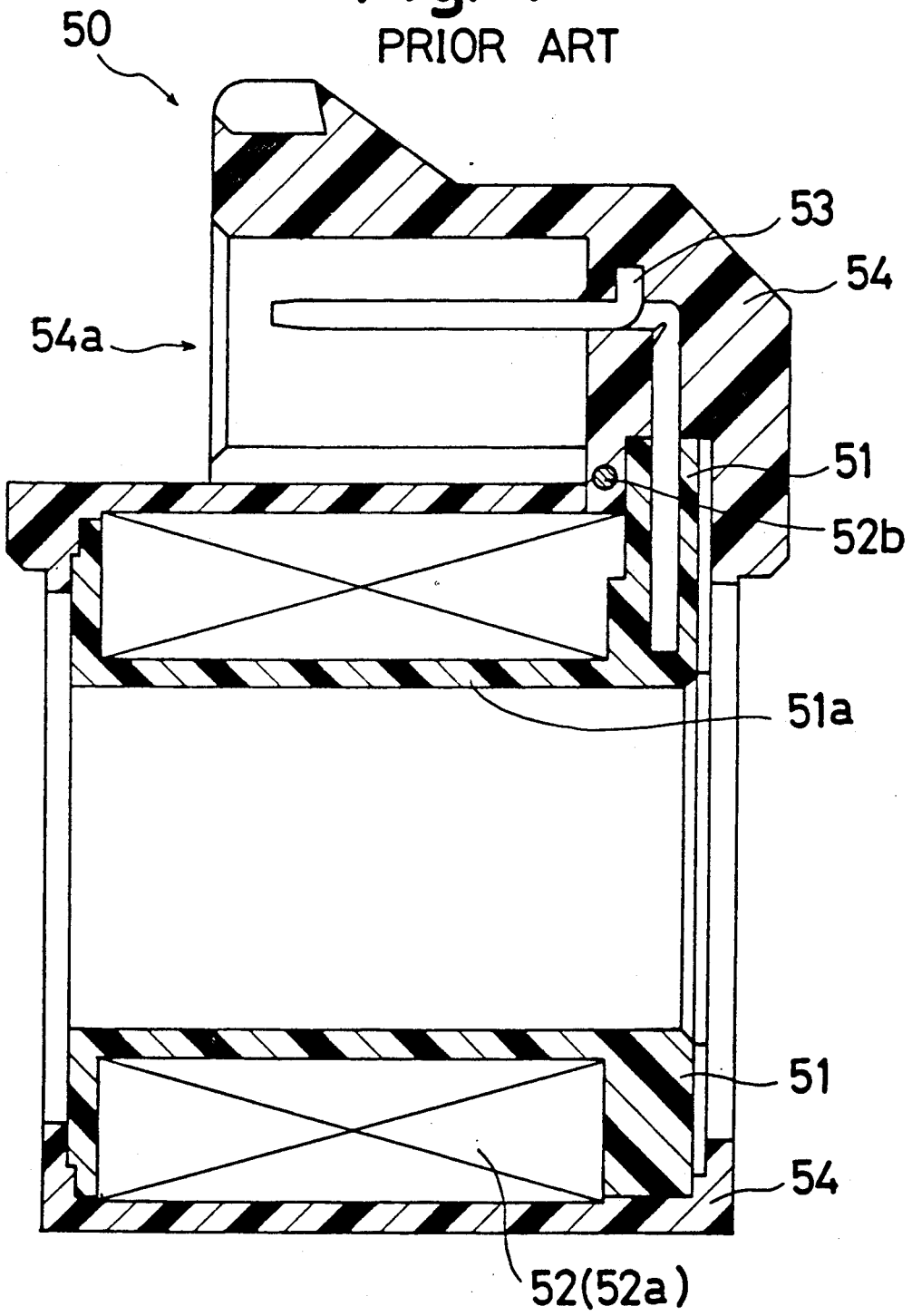
Fig. 4 PRIOR ART
FIG. 4 represents a cross-sectional view of an electromagnetic coil apparatus of the prior art.

The electromagnetic coil apparatus 10 of the present invention may be used, for example, in a hydraulic control circuit of an automobile. FIG. 1 shows a cross-sectional view of a first embodiment of the electromagnetic coil apparatus 10. FIG. 2 shows a partial enlarged view of a wire connecting portion in FIG. 1 and FIG. 3 shows a cross-sectional view of a second embodiment of the electromagnetic coil apparatus 10 of the present invention.

FIGS. 1 and 2 show the first embodiment of the present invention. Referring to FIG. 1, the electromagnetic coil apparatus 10 basically includes a coil bobbin 11, an electromagnetic coil 12, a coil housing 13, an electric terminal 14, a terminal cap 15 and an outer housing 16. The coil bobbin 11 forms a center hole 11*a* adapted to have a valve assembly (not shown) arranged therein. The electromagnetic coil 12 is comprised of a wire 12*a* wound on the coil bobbin 11. A wire end 12*b* of the wire 12*a* extends out from the electromagnetic coil 12. The coil bobbin 11 has a projecting portion 11*b* and the electric terminal 14 is molded in the coil bobbin 11 as one body. The electric terminal 14 has an L-shaped configuration. The terminal cap 15 is connected with the projecting portion 11*b* of the coil bobbin 11. The terminal cap 15 is made of elastic or resilient material, for example, rubber or other similar material. The terminal cap 15 has a concave portion 15*a*, and the concave portion 15*a* is connected to the projecting portion 11*b*. The coil wire end 12*b* is pressed against the side wall 11*c* of the projecting portion 11*b* by the elastic or resilient force of the terminal cap 15. The outer housing 16 is molded on the outer portion of the terminal cap 15 and the coil housing 13, The outer housing 16 and a partial surface of the terminal cap 15 define a cylindrical connecting portion 17.

Referring to FIG. 2, the coil wire end 12*b* is arranged between the coil bobbin 11 and the terminal cap 15. The coil wire end 12*b* is pressed against the projecting portion 11*c* by the elastic or resilient force of the terminal cap 15. To reduce frictional force, a coating material can be provided on the surface of the coil wire end 12*b*.

A second embodiment of the present invention will be described with reference to FIG. 3. Since the basic construction of the second embodiment is similar to that of the first embodiment of the present invention, only the differences therebetween will be described in the following description.

As shown in FIG. 3, the L-shaped electric terminal 14 is molded within the coil bobbin 11. The terminal cap 15 is connected with the projecting portion 11*b* of the coil bobbin 11. The electric terminal 14 is also molded in the terminal cap 15 and the coil wire end 12*b* is arranged between the terminal cap 15 and the projecting portion 11*b*. A side surface of the terminal cap 15 and the outer housing 16 form a cylindrical connecting portion 17. The terminal cap 15 is made of an elastic or resilient material, for example, rubber or other similar material. A coating material can be provided on the surface of the coil wire end 12*b* for reducing stress, if necessary.

The basic operation of the apparatus according to the present invention is similar to that of the conventional electromagnetic coil apparatus described earlier, that is, operation of the electromagnetic coil apparatus causes a valve assembly (not shown) to operate in an opening and a closing manner. As is evident from the above description, when hydraulic flow is controlled within the valve assembly, vibrations and/or heat are transmitted to the electromagnetic coil apparatus 10.

In operation, if vibrations and/or high temperature are transmitted to the electromagnetic coil apparatus 10, the terminal cap 15 absorbs the vibrations and the thermal expansion of the coil wire end 12*b*. That is to say, the serious problem in the prior art can be solved since the arrangement of the coil wire end acts to prevent breakage.

The invention has been described in an illustrative manner and it is to be understood that the terminology which has been used is intended to be in the nature of words of description rather than of limitation. Obviously, many modifications and variations of the present invention are possible in light of the above teachings. It is therefore to be understood that within the scope of the appended claims, the invention may be practiced otherwise than as specifically described.

What is claimed is:

1. An electromagnetic coil apparatus comprising:

a coil bobbin;

a wire wound on said coil bobbin and constituting an electromagnetic coil;

a projecting portion formed at an end portion of said coil bobbin;

a resilient terminal cap having a concave portion connected to said projecting portion;

said wire having an end extending outwardly from said electromagnetic coil with said wire end arranged between said concave portion of said resilient terminal cap and said projection portion and an outer housing disposed in contact with and substantially surrounding an outer surface of said coil bobbin and said terminal cap.

2. An electromagnetic coil apparatus according to claim 1, wherein an electric terminal is molded in said terminal cap and said outer housing.

3. An electromagnetic coil apparatus according to claim 1, wherein an electric terminal is molded in said terminal cap.

* * * * *